US008764183B2

(12) United States Patent
Schaeffer

(10) Patent No.: US 8,764,183 B2
(45) Date of Patent: Jul. 1, 2014

(54) DEVICE FOR HOLDING AND CARRYING ALONG A SUBSTRATE TO BE PRINTED ON AND A PRINTING MACHINE

(75) Inventor: Eugène Schaeffer, Metz (FR)

(73) Assignee: Machines Dubuit, Noisy-le-Grand (FR)

( * ) Notice: Subject to any disclaimer, the term of this patent is extended or adjusted under 35 U.S.C. 154(b) by 20 days.

(21) Appl. No.: 13/518,721

(22) PCT Filed: Dec. 9, 2010

(86) PCT No.: PCT/EP2010/069292
§ 371 (c)(1),
(2), (4) Date: Jul. 17, 2012

(87) PCT Pub. No.: WO2011/076581
PCT Pub. Date: Jun. 30, 2011

(65) Prior Publication Data

US 2012/0281051 A1 Nov. 8, 2012

(30) Foreign Application Priority Data

Dec. 22, 2009 (FR) ..... 09 59363

(51) Int. Cl.
*B41J 2/01* (2006.01)

(52) U.S. Cl.
USPC ..... 347/104; 347/101; 347/105

(58) Field of Classification Search
USPC ..... 347/104, 105, 101; 271/197
See application file for complete search history.

(56) References Cited

U.S. PATENT DOCUMENTS

| | | | | |
|---|---|---|---|---|
| 5,768,996 | A * | 6/1998 | Ackley | 101/483 |
| 8,371,216 | B2 * | 2/2013 | Chisholm et al. | 101/44 |
| 2004/0094050 | A1 * | 5/2004 | Ackley et al. | 101/44 |
| 2007/0194034 | A1 | 8/2007 | Vasiadis | |
| 2009/0284575 | A1 | 11/2009 | Verhoest et al. | |

OTHER PUBLICATIONS

Form PCT/ISA/210, WO, May 16, 2011, ISR for PCT/EP2010/069292.
Form PCT/ISA/237, WO, Written Opinion for PCT/EP2010/069292.

* cited by examiner

*Primary Examiner* — Henok Legesse
(74) *Attorney, Agent, or Firm* — Edwards Wildman Palmer LLP; Steven M. Jensen

(57) ABSTRACT

A device for holding and carrying along a substrate to be printed on, for a printing machine, comprising: a conveyor (3) comprising an endless belt (8) formed by hollow box structures (9) extending transversely and having a flat outer face and comprising means for driving the belt and means (19*a*) for guiding the box structures. The flat outer faces (17) of the box structures circulate over a flat, longitudinal path (20) forming an upper flat surface (54) for holding the substrate to be printed on, the box structures having a plurality of external orifices in their outer face and at least one internal passage in their inner face opposite their outer face. A suction device (6) is able to engage with the internal passages in the box structures circulating over a longitudinal suction region (70) corresponding to at least a part of said flat, longitudinal path (20), so as to produce suction through said external orifices in the box structures circulating over said longitudinal suction region. Inkjet printing machine comprising such a device.

19 Claims, 11 Drawing Sheets

DEVICE FOR HOLDING AND CARRYING ALONG A SUBSTRATE TO BE PRINTED ON AND A PRINTING MACHINE

This application is the US national phase, pursuant to 35 U.S.C. §371 of international Application Ser. No. PCT/EP2010/069292, filed Dec. 9, 2010, designating the United States and published in French on Jun. 30, 2011 as publication WO 2011/076581 A1, which claims priority to French application Ser. No. 0959363, filed Dec. 22, 2009. The entire contents of the aforementioned patent applications are incorporated herein by this reference.

The present invention relates to the field of printing presses and more particularly to a device for receiving and carrying material to be printed, and to a printing press comprising such a device.

Various traditional printing methods are known.

The offset printing method is known, in which a light-sensitive layer deposited on an aluminum printing plate is exposed to light and then developed chemically to form points separated by recesses approximately three hundredths of a millimeter deep, the plate which has been prepared in this way is fixed to a rotating cylinder, ink is applied to the points of the plate carried by this cylinder by a set of inking rollers, and the ink is transferred to another so-called blanket cylinder which applies the ink to the sheet of paper which is to be printed.

In order to prevent the ink from spreading over the whole printing plate, a set of dampening rollers applies a film of water to which a dampening product has been added.

The different colors to be printed are printed successively, one after the other, each by a set of corresponding cylinders and plates.

Because the paper must be moved along with a relatively complicated but accurate kinematic chain in order to obtain very accurate transferring of the printing points, for a long time it was not possible to use the offset printing method to print material with a weight greater than 250 grams per square meter. Today, it is possible in some conditions to print stiffer material but it must still be flexible.

The silkscreen printing method is also known, in which a light-sensitive layer deposited on a printing fabric or screen is exposed to light and then developed chemically in order to remove the layer on the zones corresponding to the zones which are to be printed, the screen prepared in this way is placed above but not in contact with the material to be printed, and the ink deposited on the screen is transferred through these zones and onto the material to be printed under the effect of a doctor blade.

The different colors to be printed are printed successively, one after the other, each by a corresponding screen. As each layer of ink is relatively thick, it is necessary to dry the material between each color.

Because there is no contact between the screen and the material to be printed, any kind of material, even stiff and thick material, can be printed. Moreover, any kind of ink can be used.

The flexographic printing method is also known, where a photopolymer plate is etched by exposing it to UV light in order to obtain a 3-D printing plate with raised areas and recesses approximately one millimeter deep, and ink is deposited on the peaks of the raised areas by a set of inking rollers and then directly on the sheet of paper.

Because it is flexible, the plate makes it possible to print on material which has a slightly uneven surface.

The different colors to be printed are printed successively, one after the other, each requiring a printing plate. Depending on the inks used, an intermediate UV drying operation is carried out.

The flexographic printing method is generally less accurate than offset printing but does require simpler mechanical units.

There has moreover been an attempt for some years to provide an inkjet method on an industrial scale, in which drops of ink are sprayed onto material to be printed by print heads which are controlled by a computer so that they directly transfer a digital image which is to be printed.

More particularly, a known inkjet method is of the sequential type and consists in advancing material in increments on a table, and in moving transversely a set of multi-color inkjet print heads which are carried by a carriage in order to deposit drops of ink onto the material to be printed which is held stationary between two increments.

Such a method only provides a good print quality if the drops are deposited very accurately on the material to be printed. This requires the increment by which the material is advanced to be relatively small and the printing to be carried out by several successive identical passes depositing drops of ink for each position of the stationary material to be printed. A relatively low printing speed is thus obtained which cannot rival the known methods, for example offset printing, in particular when relatively wide webs are being printed.

In an attempt to increase the printing speeds whilst maintaining an appropriate print quality, it has been observed that such an inkjet method does encounter, on the one hand, the disadvantages of sequential advance of the material to be printed, which requires a succession of perfect positioning operations, longitudinally and transversely, of the material to be printed when the latter moves from one increment to the next, and, on the other hand, the disadvantages of the back-and-forth movements of the carriage carrying the print heads.

This irregular positioning and movement produce printing defects resulting from mismatches between the drops of ink deposited on the material to be printed or from the absence of drops of ink, these defects appearing on the printed material in the form of undesired visible transverse and/or longitudinal lines and in the form of faded colors, compared with the image which is to be printed, caused by the absence of ink drops on the material to be printed and/or undesired mixtures of the ink drops.

The subject of the present invention is a device for receiving and feeding material to be printed, which aims to improve the printing conditions, in particular on an inkjet printing press.

A printing press with inkjet print heads, comprising a device for receiving and feeding material to be printed, which is associated with a suction device, will now be described with reference to the drawings, in which.

Figure 1:
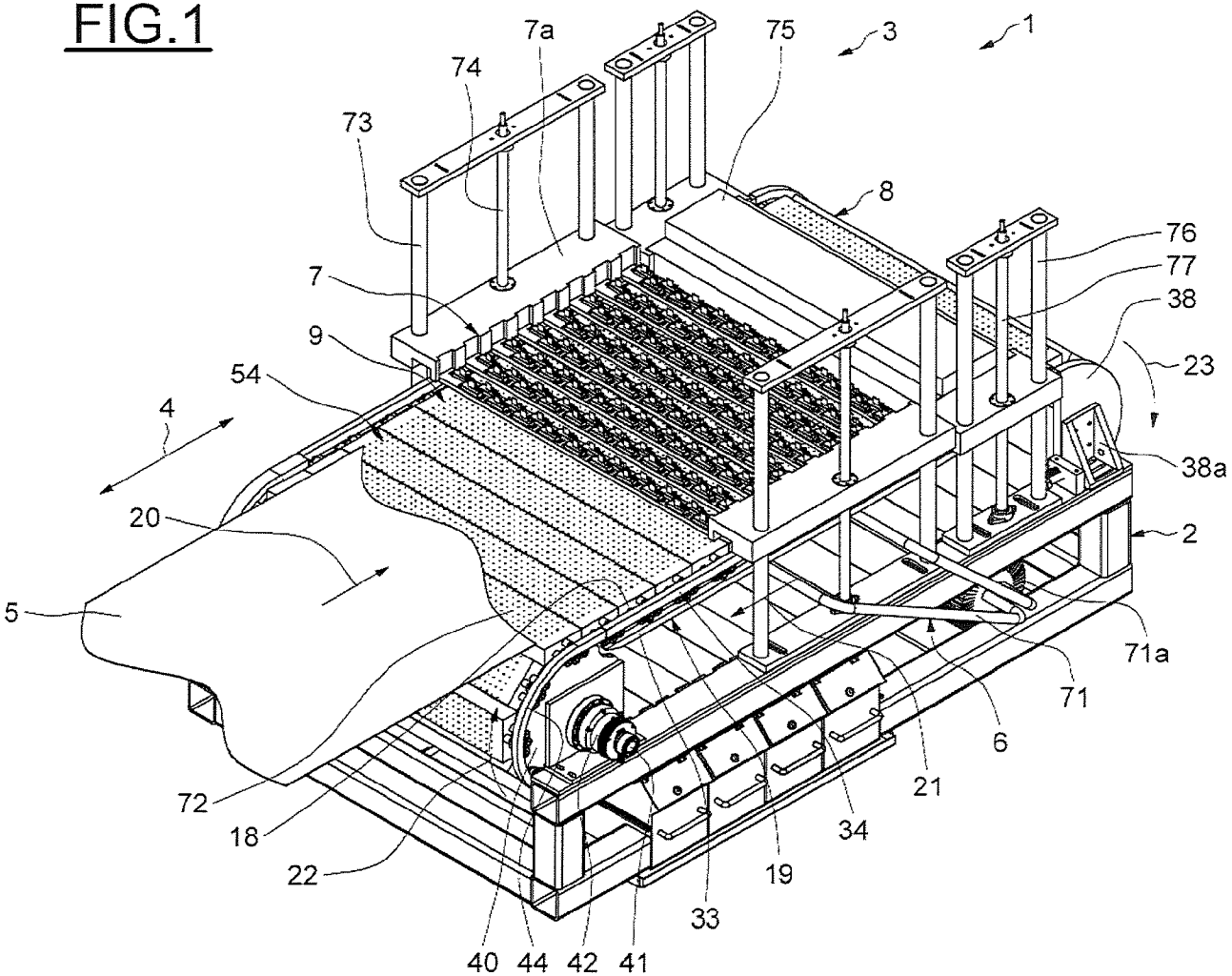
FIG. 1 shows a perspective view from above of a printing press.

The printing press 1 comprises a frame 2, a conveyor 3 intended to transport material to be printed 5, for example a sheet of paper, in a longitudinal direction 4, a suction device 6 associated with the conveyor 3 and a set 7 of inkjet print heads for depositing drops of ink on the material to be printed 5, which is arranged on and fed through by the conveyor 3.

The conveyor 3 comprises an endless mat 8, in other words one forming a closed loop, formed from a plurality or series of identical hollow box structures 9 situated next to one another.

The hollow box structures 9 take the form of sections which, in the longitudinal direction 4, have rectangular cross-sections and axes that extend transversely to said longitudinal direction 4, and are arranged one after the other.

Figure 11:
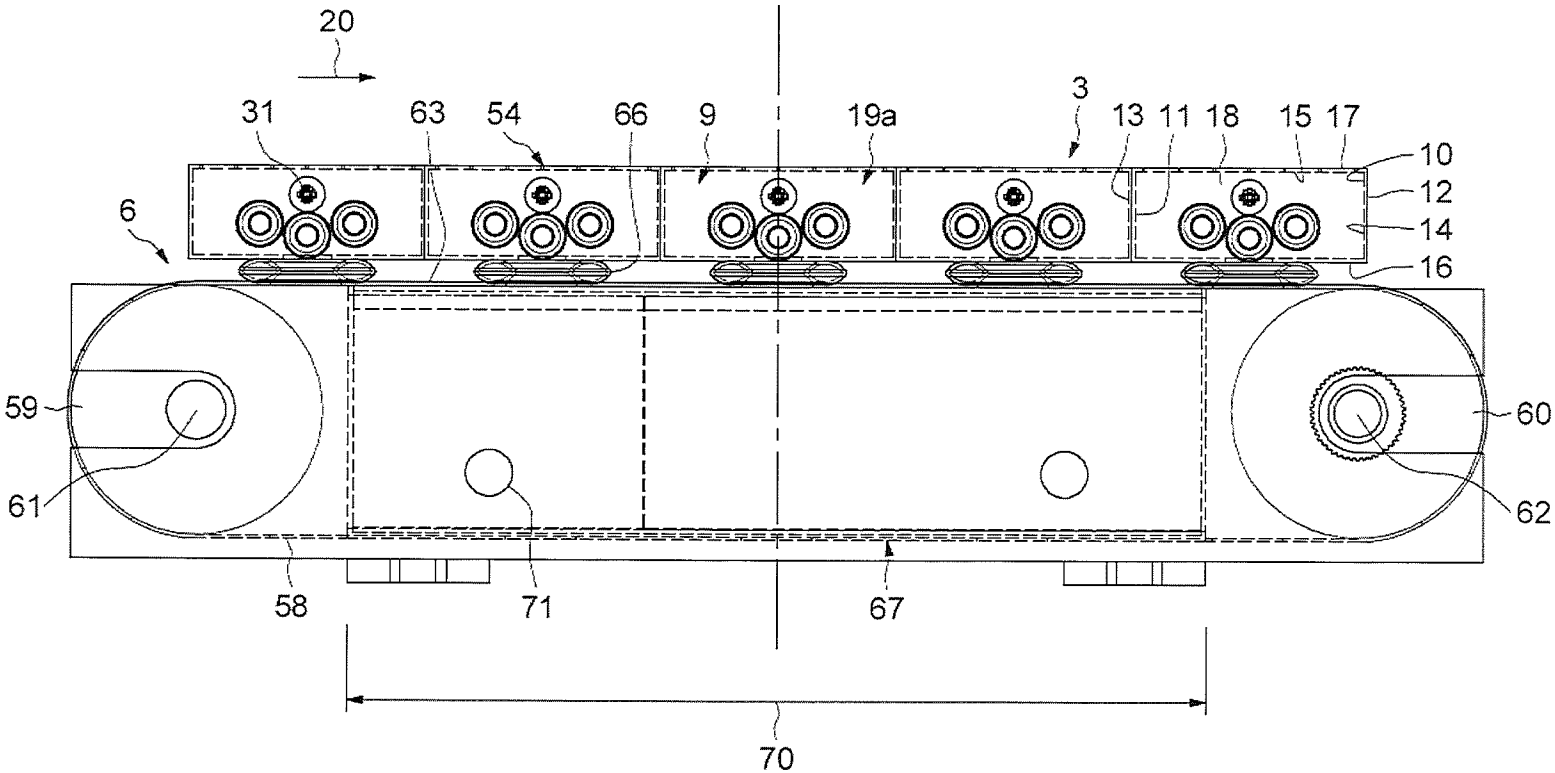
FIG. 11 shows a side view of the suction device and part of the receiving and feeding device of the printing press from FIG. 1.

As can be seen in particular in FIG. 11, the hollow box structures 9 comprise opposing short walls 10 and 11 that determine opposing small faces 12 and 13, which are adjacent from one box structure to the next, opposing long walls 14 and 15 that determine opposing large faces, an inner large face 16 being situated on the inside of the endless mat 8 and an outer large face 17 being situated on the outside of said endless mat 8. The hollow box structures 9 are closed at their ends by opposing end walls 18 which extend in the longitudinal direction 4.

As can be seen in particular in FIG. 1, the ends 18 of the hollow box structures 9 are respectively associated with guide means 19 such that hollow box structures extend flat over a horizontal upper longitudinal track 20 directed from upstream to downstream, and hollow box structures extend flat over an opposite horizontal lower longitudinal track 21 directed from downstream to upstream. Between these tracks 20 and 21, hollow box structures extend over a semi-circular upstream return track 22, and hollow box structures extend over a semi-circular upstream return and reversing track 23.

As can be seen in particular in FIGS. 3, 4 and 5, the guide means 19 can comprise sets of rollers 19*a* formed as follows.

The opposing end walls 18 of the hollow box structures 9 carry two transverse rods 24 and 25 on their outside, which are situated in a plane parallel with the large external faces 17, and a central transverse rod 26 situated between the two rods 24 and 25 and offset toward the large internal face 16. The transverse rods 24, 25 and 26 carry guide rollers 27, 28 and 29 which can be formed by cylindrical ball bearings. The rollers are thus arranged in triangles, the sides that correspond to the rollers 27 and 28 being parallel with the large external faces 17, and the vertices opposite these sides being offset toward the large internal faces 16.

The opposing end walls 18 of the hollow box structures 9 also carry, on the outside, central transverse rods 30, at the ends of which centering rollers 31 are mounted, their axes being arranged perpendicularly to the large faces 16 or 17. The centering rollers 31 situated on one side can be stressed by spacing springs 30*a* in order to press them against the lateral guides.

The guide means 19 comprise, on either side of the endless mat 8, opposing upper longitudinal slideways 32 formed by lower and upper longitudinal bars 33 and 34, mounted on the frame 2, between which the guide rollers 27, 28 and 29 of the ends of the hollow box structures 9 situated on the upper horizontal longitudinal track 20 can circulate, it being possible for the rollers 29 to be in contact with the lower bars 33 and the rollers 27 and 28 to be in contact with the upper bars 34 so as to guide the box structures 9 horizontally.

Furthermore, the centering rollers 31 can be in contact with the facing sides of the upper longitudinal bars 34.

In an equivalent fashion, the guide means 19 comprise, on either side of the endless mat 8, opposing lower longitudinal slideways 35 formed by lower and upper longitudinal bars 36 and 37, mounted on the frame 2, between which the guide rollers 27, 28 and 29 of the ends of the hollow box structures 9 situated on the upper horizontal longitudinal track 21 can circulate, it being possible for the rollers 29 to be in contact with the upper bars 27 and the rollers 27 and 28 to be in contact with the lower bars 36 so as to guide the box structures 9 horizontally.

Furthermore, the centering rollers 31 can be in contact with the facing sides of the lower longitudinal bars 36.

Figure 6:
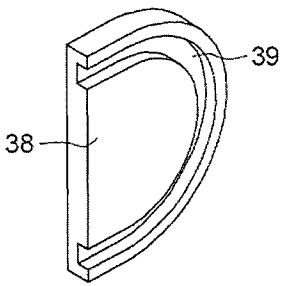
FIG. 6 shows an enlarged perspective view of another part of the device from FIG. 4.

As can be seen in particular in FIG. 6, to determine the downstream return and reversing track 23 of the hollow box structures 9, the guide means 19 comprise, on either side of the endless mat 8, downstream opposing longitudinal plates 38 in which semi-circular grooves 39 are formed in which the guide rollers 27, 28 and 29 of the ends of the hollow box structures 9 are engaged. Furthermore, the centering rollers 31 can be in contact with the facing sides of the opposing longitudinal plates 38.

The semi-circular grooves 39 determine downstream paths situated in the extension of the horizontal paths determined by the opposing upper longitudinal slideways 32 and the opposing lower longitudinal slideways 35.

Figure 4:
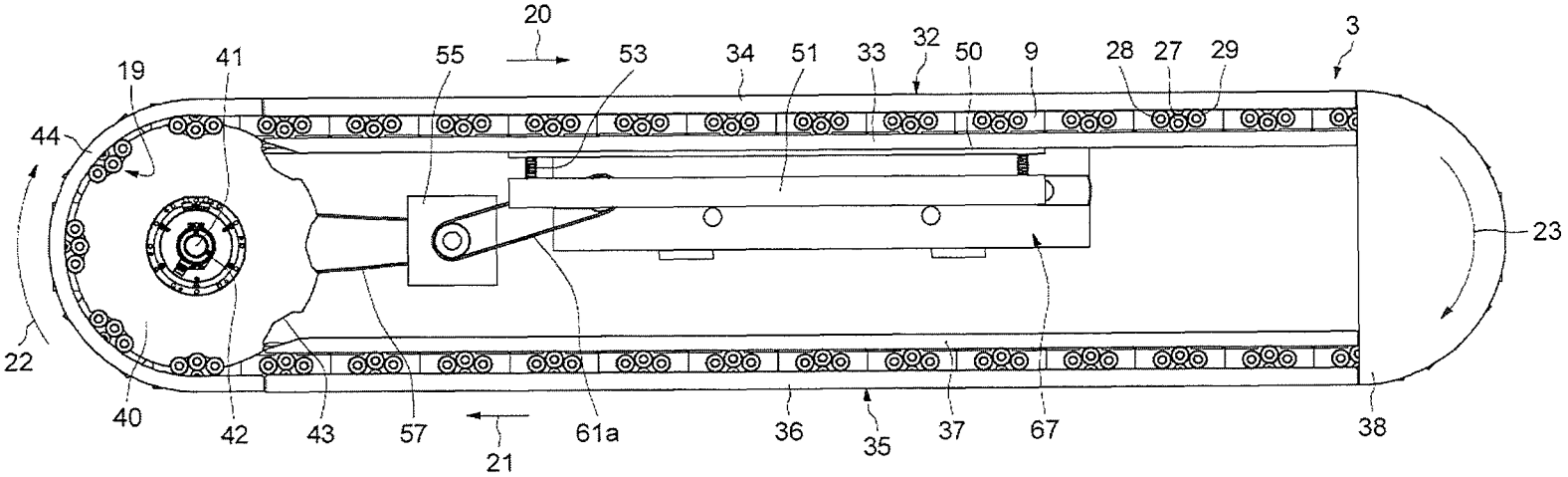
FIG. 4 shows a partial side view of a receiving and feeding device of the printing press from FIG. 1.
Figure 5:
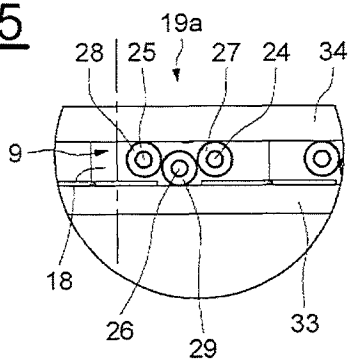
FIG. 5 shows an enlarged side view of part of the device from FIG. 4.
Figure 7:
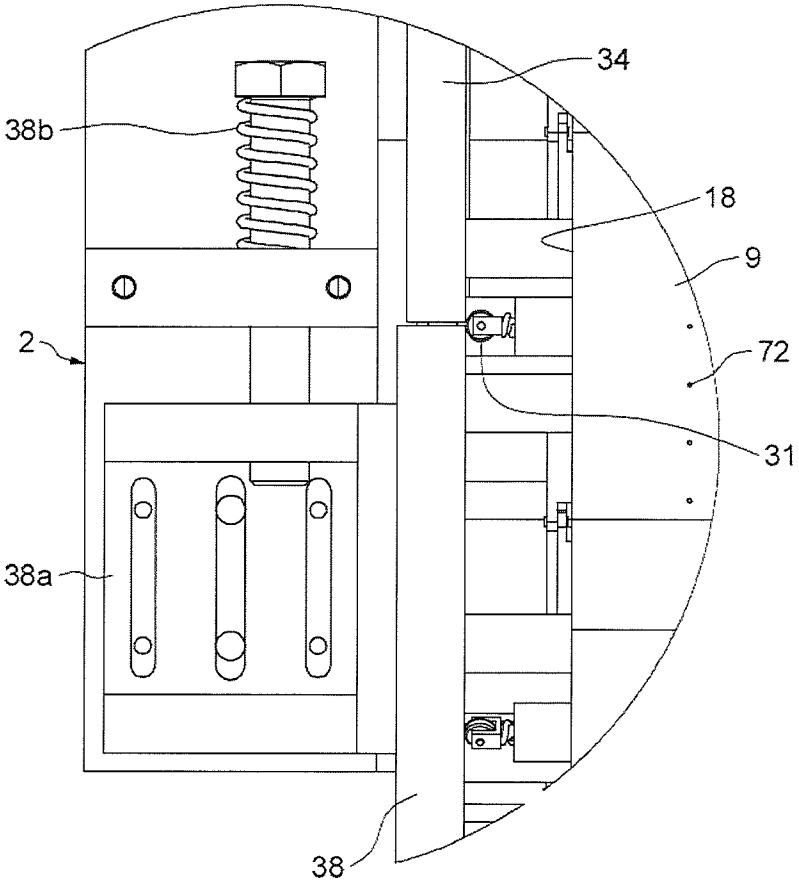
FIG. 7 shows a view from above of a compression part of the printing press from FIG. 1.
Figure 9:
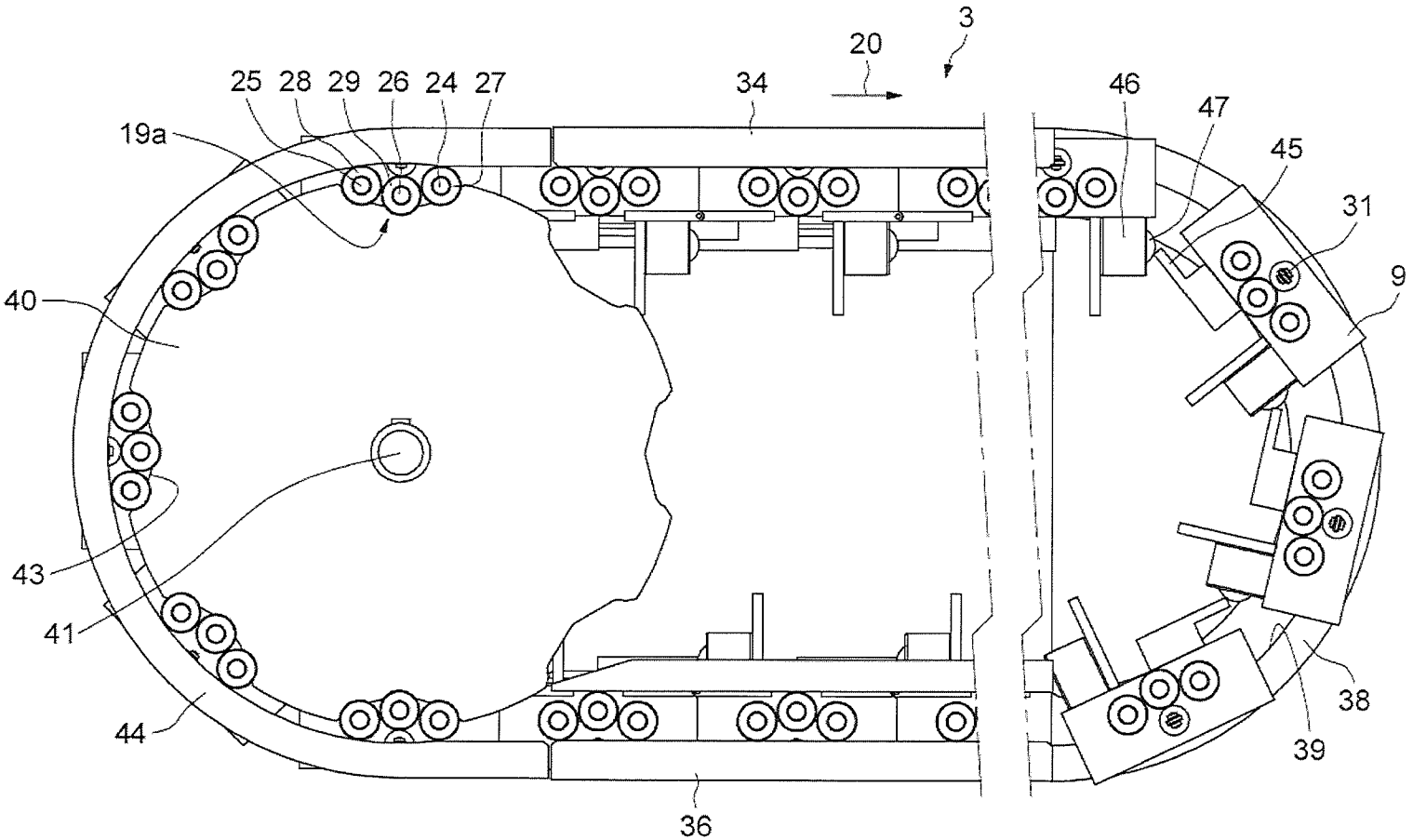
FIG. 9 shows a partial enlarged side view of the receiving and feeding device of the printing press from FIG. 1.
Figure 10:
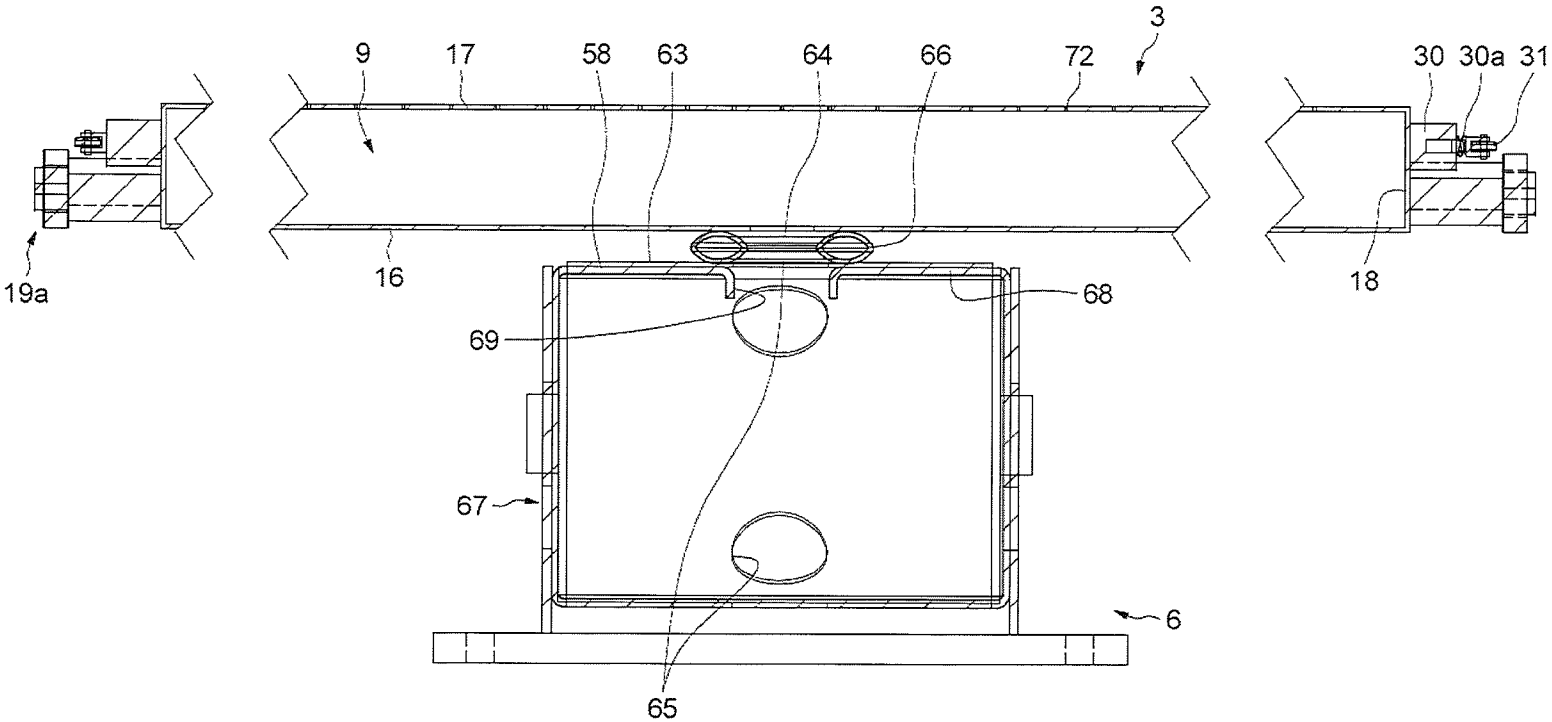
FIG. 10 shows a view in cross-section of a suction device and part of the receiving and feeding device of the printing press from FIG. 1.

As can be seen in particular in FIGS. 4 and 9, to determine the downstream return and reversing track 22 of the hollow box structures 9, the guide means 19 comprise, on either side of the endless mat 8, opposing notched wheels 40 integral with a transverse shaft 41 mounted on the frame 2 via bearings 42, the wheels 40 having peripheral notches 43 that receive the transverse end rods 24, 25 and 26 of the hollow box structures 9 crosswise.

The guide means 19 also comprise curved upstream bars 44 mounted on the frame 2 and against the outside of which the rollers 27 and 28 of the hollow box structures 9 can be in contact, on the upstream return and reversing track 22. Furthermore, the centering rollers 31 can be in contact with the facing sides of the curved bars 44.

The opposing notched wheels 40 and the opposing curved upstream bars 44 determine upstream paths situated in the extension of the horizontal paths determined by the opposing upper longitudinal slideways 32 and the opposing lower longitudinal slideways 35.

As can be seen in FIG. 9, the box structures 9 are equipped on their internal walls 14, on the one hand, with arms 45 and supports 46 for balls 47 arranged in such a way that, on the longitudinal tracks 20 and 21, the ends of the arms 45 of the hollow box structures 9 are at a small distance from the balls 47 of the adjacent hollow box structures 9 so that the small faces 12 and 13 of the hollow box structures 9 can be in contact and that, on the return and reversing tracks 22 and 23, the ends of the arms 45 of the adjacent hollow box structures 9 bear against balls 47 of the adjacent hollow box structures 9 so that their small faces 12 and 13 are spaced apart from each other.

The opposing longitudinal plates 38 situated downstream are mounted on the frame 2 via longitudinal slides 38*a* acted on by springs 38*b* that act so as to longitudinally bring the opposing longitudinal plates 38 closer to the wheels 40 situated upstream, in such a way that the springs 38*b* form play absorption means such that the hollow box structures 9 are forced toward one another.

The hollow box structures 9 situated along the longitudinal tracks 20 and 21 thus bear firmly against one another or are in contact with one another via their small faces 12 and 13, and the hollow box structures 9 situated along the return and reversing tracks 22 and 23 are spaced apart and are joined by contact via the arms 45 and the balls that they carry, the rollers 27 and 28 bearing against the external faces of the grooves 39 of the opposing downstream plates 38 and against the internal faces of the curved upstream bars 44.

Other means of articulation could be provided to space the box structures 9 apart and hold them in contact with one another along the return and reversing tracks 22 and 23. For example, the box structures could be connected by means having suitable hinges, for example with axes that are offset inwards relative to the internal faces 16 of the box structures 9.

Figure 3:
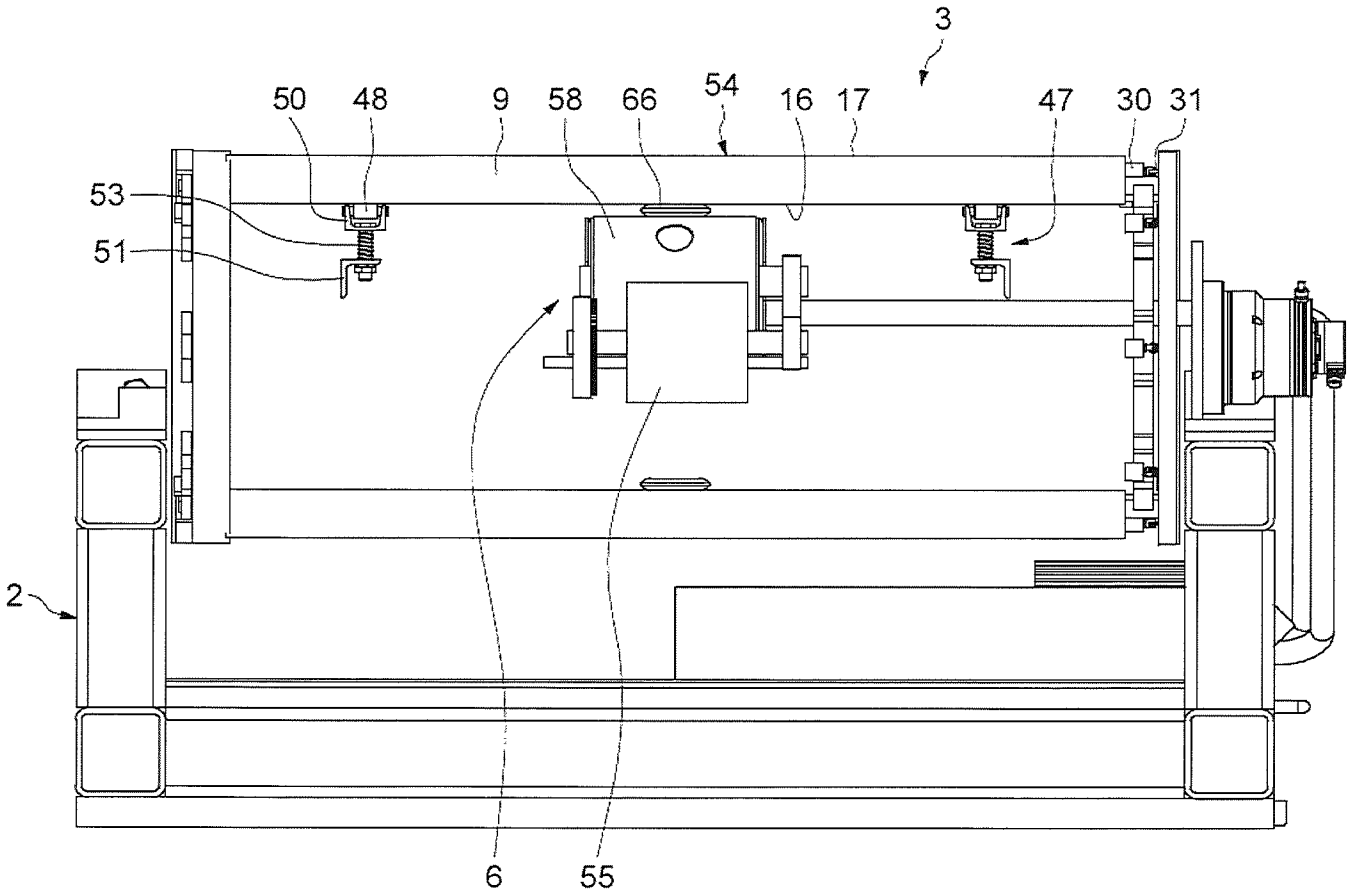
FIG. 3 shows a partial view from behind, looking forwards, of the printing press from FIG. 1.
Figure 8:
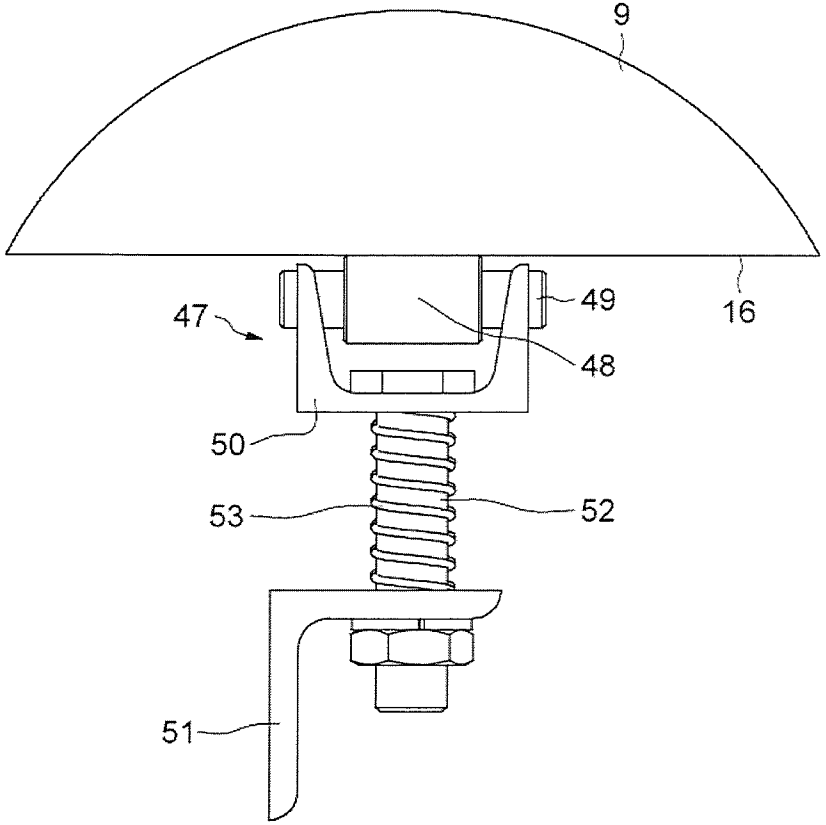
FIG. 8 shows an enlarged view from behind, looking forwards, of a bearing means of the printing press from FIG. 1.

As can be seen in particular in FIGS. 3 and 8, two series of counterpressure rollers 48 with transverse axles 49 and bearing against the lower faces 16 of these box structures are provided beneath the hollow box structures 9 circulating on the upper longitudinal track 20. These rollers are carried by longitudinal bars 50, which are mounted on supports 51 of the frame 2 via sliding rods 52 and are forced upwards by springs 53 placed around the rods 52. The counterpressure rollers 48 consequently exert upward forces on the hollow structures 9 and the guide rollers 27 and 29 are thus held in contact with the upper guide bars 34. The series of counterpressure rollers 48 are placed in proximity to the lateral ends of the hollow box structures 9 and cover virtually the length of the upper longitudinal track 20 such that the external faces 17 of the hollow box structures 9 circulating on this upper longitudinal track 20 can be aligned and determine a perfectly flat upper surface 54 for receiving the material to be printed 5.

In order to drive the endless mat 8 of the conveyor 3, formed by the hollow box structures 9, an electric motor 55 is provided which has a transverse axle 56 connected to the transverse shaft 41 carrying the drive wheels 40 via a belt engaging with pinions mounted on these shafts.

With reference in particular to FIGS. 10 to 13, the suction device 6 of the printing press 1 will now be described.

This suction device 6 comprises a longitudinal endless belt 58 mounted on two drums 59 and 60 with transverse shafts 61 and 62, the ends of which are carried by the frame 2, such that the longitudinal endless belt 58 has an upper portion 63 which extends at a small distance from, and may be in contact with, the lower faces 16 of the hollow box structures 9 circulating on at least part of the upper longitudinal track 20 of the endless mat 8 and advantageously on at least part of the longitudinal track determined by the series of counterpressure rollers 48. The width of the endless belt 58 is such that its upper portion 63 covers the central part of the lower faces 16 of the hollow box structures 9 circulating on these tracks.

The internal walls 14 of the hollow box structures 9 each have a central through passage 64, such that the through passages 64 of the hollow box structures 9 circulating on the upper longitudinal track 20 are established with a specified pitch P (FIG. 11).

Figure 12:
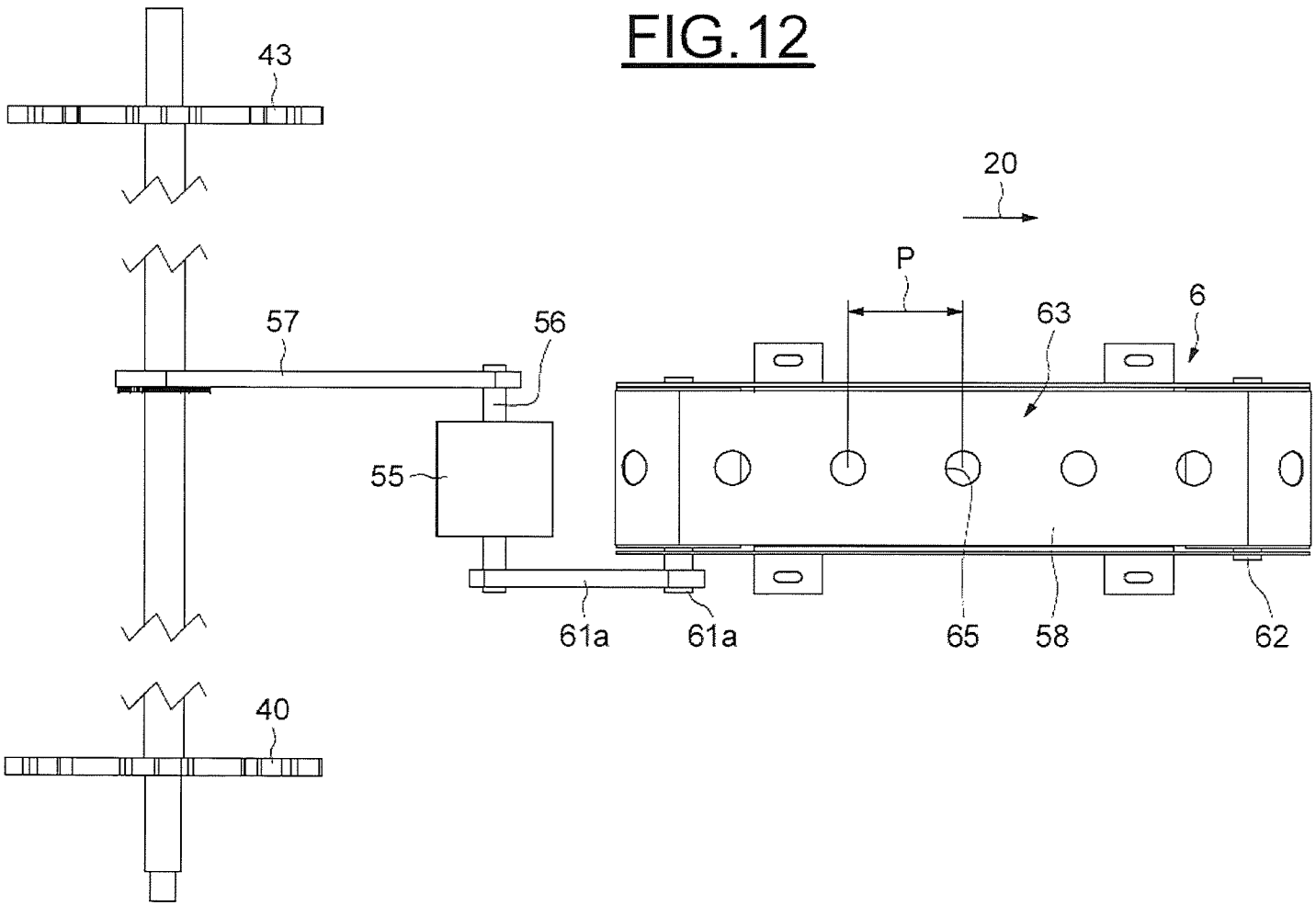
FIG. 12 shows a view from above of the suction device and part of the receiving and feeding device of the printing press from FIG. 1.
Figure 13:
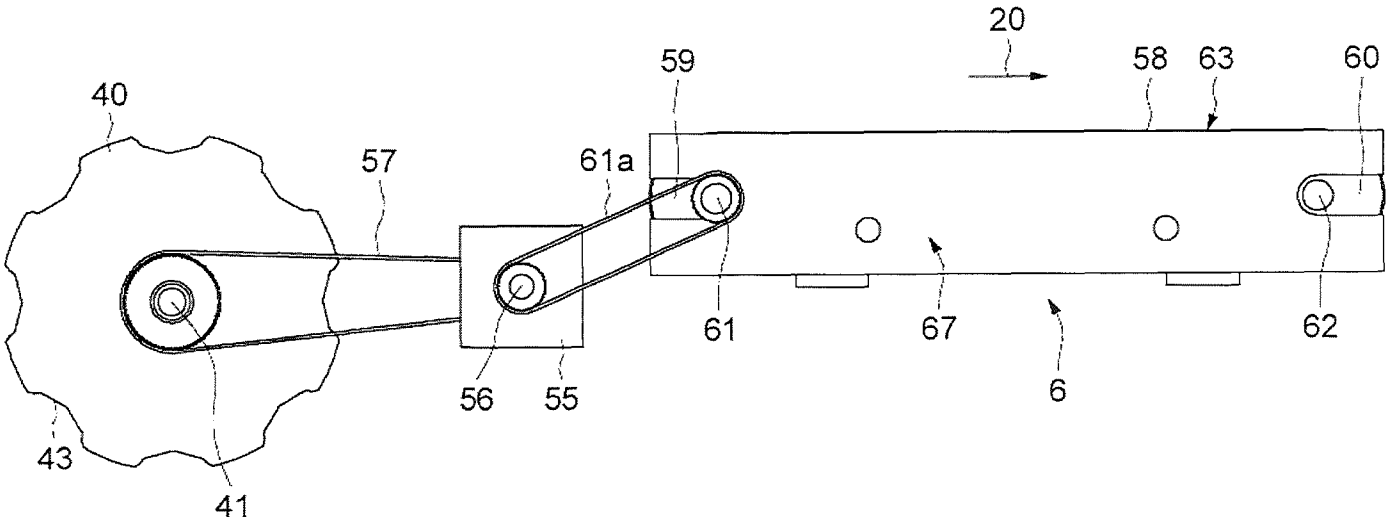
FIG. 13 shows a simplified side view of the suction device and part of the receiving and feeding device of the printing press from FIG. 1.

The longitudinal endless belt 58 has a plurality of through passages 65 provided along its central part and established with the pitch P (FIGS. 11 and 12).

The shaft 61 of the drum 59 is connected to the axle 56 of the electric motor 55 by a belt 61*a*.

The rotation ratio between the shaft 41 driving the longitudinal endless mat 8 of hollow box structures 9 and the shaft 61 driving the longitudinal endless belt 58 is such that the through passages 65 of the endless belt 58 circulating on its upper portion 63 can correspond or coincide with the through passages 64 of the hollow box structures 9 circulating on a length of the upper longitudinal track 20 corresponding to the length of the upper portion 63, the through passages 64 and the through passages 65 being initially placed so as to obtain this arrangement.

The hollow box structures 9 are equipped on their internal faces 16 with annular seals 66 which surround their through passages 64 and come into contact with the upper portion 63 of the endless belt 58.

The suction device 6 of the printing press 1 also comprises a suction box 67 carried by the frame 2 and having a flat upper wall 68 against which the upper portion 63 of the longitudinal endless belt 58 bears flat, such that the annular seals 66 are at least slightly crushed. The suction box 67 extends longitudinally in proximity to the drums 59 and 60.

The unit formed by the endless belt 58, the drums 59 and 60 and the suction box 67 is placed between the box structures 9 circulating on the tracks 20 and 21 and at a distance from those circulating on the lower track 21.

The flat upper wall 68 of the suction box 67 has a longitudinal opening 69 which is situated on the track of the through passages 65 of the endless belt 58 and which determines a longitudinal suction zone 70 (FIG. 11) corresponding to hollow box structures 9 circulating on the upper longitudinal track 20.

Figure 2:
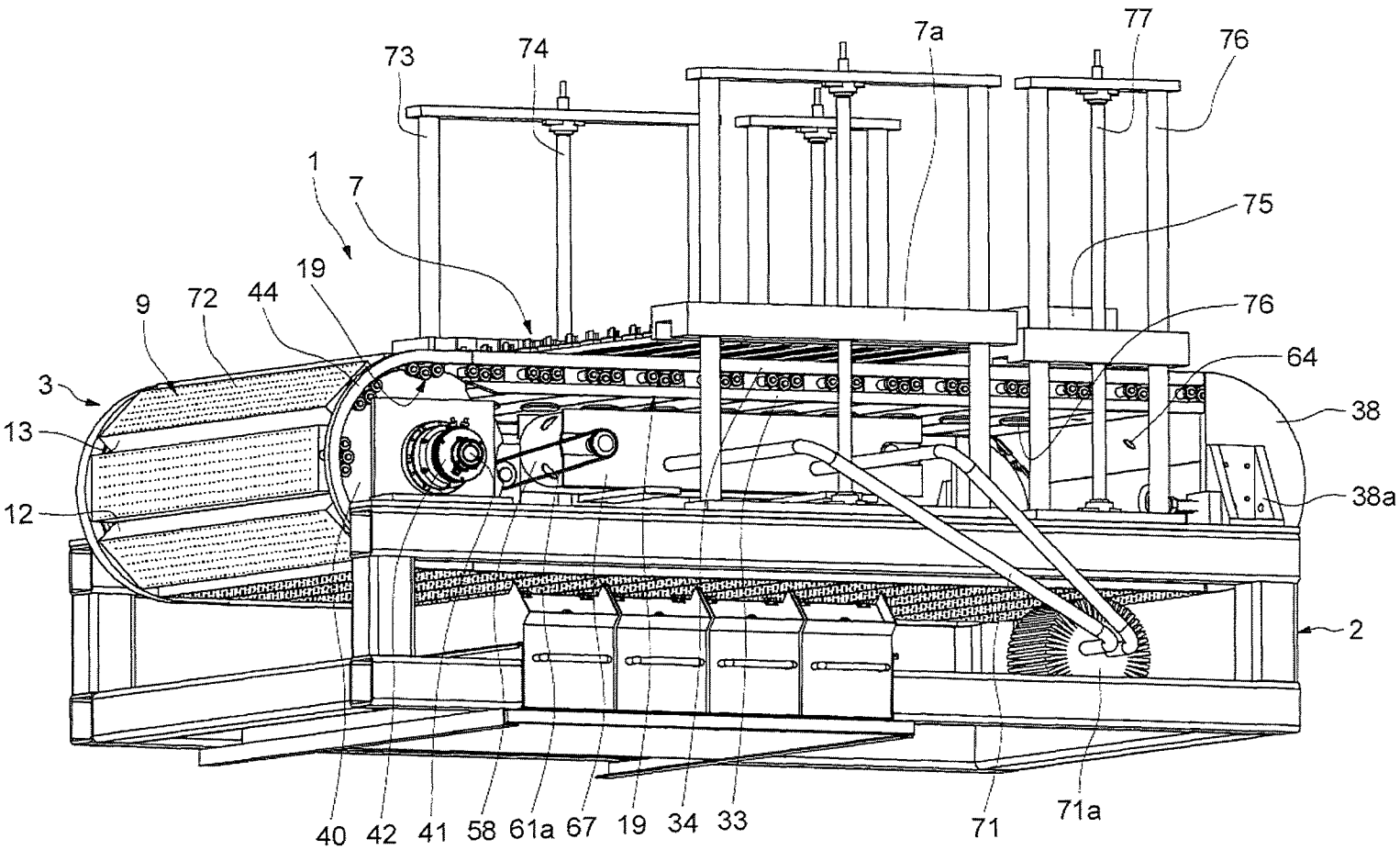
FIG. 2 shows a perspective view from below of the printing press from FIG. 1.

The suction box 67 is connected to a pump 71*a* by a duct 71 (FIGS. 1 and 2).

The external walls 15 of the hollow box structures 9 have a plurality of distributed and relatively dense through orifices 72.

Thus, when the longitudinal endless mat 8 of hollow box structures 9 and the endless belt 58 are driven as described above, the suction source can establish suction through the orifices 72 of the hollow box structures 9 circulating over the suction zone 70, through these box structures, through the through passages 64 of these box structures, through the through passages 64 corresponding to the endless belt 58, through the upper opening 69 of the suction box 67, through this box 67 and through the duct 71.

As a result, by virtue of the above-described suction, material to be printed 5 circulating in bearing fashion on the external faces of the hollow box structures 9 circulating on the upper longitudinal track 20 can be applied firmly to the external faces 17 of the box structures 9 circulating on the suction zone 70, the flat receiving surface 54 extending over a longitudinal zone that includes the longitudinal suction zone 70 and is advantageously longer upstream than downstream.

The unit 7 of inkjet print heads of the printing press 1, placed at a distance from the ends of the upper track 20, covers at least part of the suction zone 70, such that, in the corresponding print zone, the material to be printed 5 can be absolutely flat and the distance between these injection heads and the material to be printed 5 can be ensured when the material to be printed 5 circulates longitudinally and the print heads are activated.

As can be seen in particular in FIGS. 1 and 2, the unit 7 of inkjet print heads of the printing press 1 is mounted on a support 7*a*, the height of which can be adjusted relative to the external faces 17 of the box structures 9 circulating on the suction zone 70, along vertical slides 73 and using a screw-and-nut system 74, which are arranged laterally on either side of the mat 8 of box structures 9 and mounted on the frame 2.

As can be seen in particular in FIGS. 1 and 2, the printing press 1 can also comprise a transverse drier 75 placed downstream of the unit 7 of print heads, the height of which can be adjusted relative to the flat receiving surface 54, along vertical slides 76 and using a screw-and-nut system 77, which are arranged laterally on either side of the mat 8 of box structures 9 and mounted on the frame 2.

The suction box 67 could be connected to a pressure source to eject air through the orifices in the box structures 9. It could also be compartmentalized so that, for example, its downstream part can be connected to a pressure source to eject air through the orifices 72 of the box structures 9 circulating above it.

For the case where the material to be printed does not cover the suction zone completely, it could be provided that the reduced pressure in the suction box 67 is regulated by regulating the pump 71*a*. Moreover, the through orifices 72 could have different cross-sections. For example, through orifices could be provided which have a certain cross-section in the central part of the external walls 15 of the hollow box structures 9, in such a way that these through orifices with a certain cross-section of the box structures are on a central longitudinal zone, and through orifices with a smaller cross-section are on at least two longitudinal lateral zones situated on either side of this central longitudinal zone.

The invention claimed is:

1. A device for receiving and carrying material to be printed, for a printing press, comprising:

a conveyor comprising an endless mat formed from a plurality of box structures that extend transversely and each have a flat external face, and comprising drive means for the endless mat and guide means for the box structures such that the flat external faces of the box structures circulating on a flat longitudinal track form an upper flat surface for receiving the material to be printed, the box structures each having a plurality of outer orifices in the external face and at least one inner passage in an internal face opposite the external face; and a suction device configured to interact with the inner passages of the box structures circulating over a longitudinal suction zone corresponding to at least part of said flat longitudinal track so as to create suction through said outer orifices of the box structures circulating on said longitudinal suction zone, wherein the suction device comprises an endless belt which has through passages and guide means for the endless belt such that the guide means for the endless belt has a portion that forms a surface adjacent to the internal faces of the box structures over the longitudinal suction zone, a drive means for driving the endless belt such that the through passages of the endless belt correspond with the inner passages of the box structures over the longitudinal suction zone while the endless mat is driven, and a suction box having an opening adjacent to the through passages of the endless belt on the longitudinal suction zone, and a pump means connected to the suction box.

2. The device as claimed in claim 1, wherein at least one of the box structures and the endless belt is equipped with annular seals which surround the inner passages and the through passages and are configured to come into contact with the at least one of the endless belt and the box structures circulating over at least said longitudinal suction zone.

3. The device as claimed in claim 1, wherein the suction box comprises a wall in which the opening is formed and against which the internal face of said endless belt bears over at least part of said longitudinal suction zone.

4. The device as claimed in claim 1, wherein the box structures have adjacent transverse faces bearing against one another over at least the flat longitudinal track.

5. The device as claimed in claim 1, wherein the box structures have means of articulation with one another.

6. The device as claimed in claim 1, further comprising gap absorption means which are configured to bring the hollow box structures closer to one another.

7. The device as claimed claim 1, wherein the ends of the box structures are equipped with movable rollers in the guide means.

8. The device as claimed in claim 1, wherein the ends of the box structures are equipped with fastening means configured to interact with notches of return wheels.

9. The device as claimed in claim 1, wherein the box structures have flat internal faces which are parallel with the external faces.

10. A printing press comprising:

a device for receiving and carrying material to be printed, the device comprising:

a conveyor comprising an endless mat formed from a plurality of box structures that extend transversely and each have a flat external face, and comprising drive means for the endless mat and guide means for the box structures such that the flat external faces of the box structures circulating on a flat longitudinal track form an upper flat surface for receiving the material to be printed, the box structures each having a plurality of outer orifices in the external face and at least one inner passage in an internal face opposite the external face; and a suction device configured to interact with the inner passages of the box structures circulating over a longitudinal suction zone corresponding to at least part of said flat longitudinal track so as to create suction through said outer orifices of the box structures circulating on said longitudinal suction zone, wherein the suction device comprises an endless belt which has through passages and guide means for the endless belt such that the guide means for the endless belt has a portion that forms a surface adjacent to the internal faces of the box structures over the longitudinal suction zone, a drive means for driving the endless belt such that the through passages of the endless belt correspond with the inner passages of the box structures over the longitudinal suction zone while the endless mat is driven, and a suction box having an opening adjacent to the through passages of the endless belt on the longitudinal suction zone, and a pump means connected to the suction box, and the printing press further comprising a plurality of inkjet print heads situated above said receiving surface, over a print zone corresponding to at least part of a second longitudinal track.

11. The printing press as claimed in claim 10, further comprising a drying box structure arranged downstream from said print zone and situated above said receiving surface.

12. The printing press as claimed in claim 10, wherein at least one of the box structures and the endless belt is equipped with annular seals which surround the inner passages and the through passages and are configured to come into contact with the at least one of the endless belt and the box structures circulating over at least said longitudinal suction zone.

13. The printing press as claimed in claim 10, wherein the suction box comprises a wall in which the opening is formed and against which the internal face of said endless belt bears over at least part of said longitudinal suction zone.

14. The printing press as claimed in claim 10, wherein the box structures have adjacent transverse faces bearing against one another over at least the flat longitudinal track.

15. The printing press as claimed in claim 10, wherein the box structures have means of articulation with one another.

16. The printing press as claimed in claim 10, further comprising gap absorption means which are configured to bring the hollow box structures closer to one another.

17. The printing press as claimed in claim 10, wherein the ends of the box structures are equipped with movable rollers in the guide means.

18. The printing press as claimed in claim 10, wherein the ends of the box structures are equipped with fastening means configured to interact with notches of return wheels.

19. The printing press as claimed in claim 10, wherein the box structures have flat internal faces which are parallel with the external faces.

* * * * *